US009976400B2

(12) United States Patent
Ayasse

(10) Patent No.: US 9,976,400 B2
(45) Date of Patent: May 22, 2018

(54) METHOD FOR PRODUCING OIL FROM INDUCED FRACTURES USING A SINGLE WELLBORE AND MULTIPLE-CHANNEL TUBING

(71) Applicant: IOR Canada Ltd., Calgary (CA)

(72) Inventor: Conrad Ayasse, Calgary (CA)

(73) Assignee: IOR CANADA LTD., Alberta (CA)

( * ) Notice: Subject to any disclaimer, the term of this patent is extended or adjusted under 35 U.S.C. 154(b) by 389 days.

(21) Appl. No.: 14/324,071

(22) Filed: Jul. 3, 2014

(65) Prior Publication Data

US 2015/0007996 A1 Jan. 8, 2015

(30) Foreign Application Priority Data

Jul. 4, 2013 (CA) ..... 2820742
Nov. 28, 2013 (CA) ..... 2835592

(51) Int. Cl.
*E21B 43/26* (2006.01)
*E21B 43/14* (2006.01)
*E21B 43/17* (2006.01)

(52) U.S. Cl.
CPC ..... *E21B 43/14* (2013.01); *E21B 43/17* (2013.01); *E21B 43/26* (2013.01)

(58) Field of Classification Search
CPC ..... E21B 33/12; E21B 43/26
See application file for complete search history.

(56) References Cited

U.S. PATENT DOCUMENTS 4,068,717 A 1/1978 Needham
4,687,059 A 8/1987 Pathak et al.
4,733,726 A 3/1988 Alameddine et al.
(Continued)

FOREIGN PATENT DOCUMENTS

GB 2512122 * 9/2014 ..... E21B 43/24
WO WO2012/054139 * 4/2012 ..... E21B 43/26
WO WO-2013/130491 A2 9/2013

OTHER PUBLICATIONS

Office Action dated Feb. 10, 2017, received in U.S. Appl. No. 14/324,061.

(Continued)

*Primary Examiner* — William D Hutton, Jr.
*Assistant Examiner* — Avi T Skaist
(74) *Attorney, Agent, or Firm* — Foley & Lardner LLP

(57) ABSTRACT

A method for sweeping a subterranean petroleum reservoir and recovering hydrocarbons therefrom. Such method utilizes a plurality of spaced hydraulic fractures extending radially outwardly from, and spaced laterally along, a length of a single horizontal wellbore drilled through the reservoir. The hydraulic fractures are each in fluid communication with the drilled wellbore. A multi-channel tubing having a plurality of individual discrete channels therein extending along substantially a length thereof is placed in the horizontal wellbore, and at least one packer element situated along a length of said tubing is employed. The plurality of channels in the multi-channel tubing comprise, at a minimum, a fluid injection channel for transmitting a driving fluid to hydraulic fractures in the reservoir, and a separate hydrocarbon recovery channel for collecting hydrocarbons which drain into the reservoir and producing them to surface.

11 Claims, 8 Drawing Sheets

(56) References Cited

U.S. PATENT DOCUMENTS

| | | | | |
|---|---|---|---|---|
| 6,298,916 | B1 * | 10/2001 | Tibbles | E21B 34/14 166/145 |
| 7,069,990 | B1 | 7/2006 | Bilak | |
| 7,441,603 | B2 | 10/2008 | Kaminsky et al. | |
| 8,122,953 | B2 | 2/2012 | Cavender et al. | |
| 2005/0072567 | A1 * | 4/2005 | Steele | E21B 43/2408 166/272.3 |
| 2006/0118305 | A1 * | 6/2006 | East, Jr. | E21B 43/16 166/308.2 |
| 2006/0175061 | A1 | 8/2006 | Crichlow | |
| 2006/0180306 | A1 | 8/2006 | Stone | |
| 2006/0289157 | A1 | 12/2006 | Rao | |
| 2008/0087425 | A1 | 4/2008 | Hsu et al. | |
| 2011/0278010 | A1 * | 11/2011 | Fehr | E21B 33/124 166/308.1 |
| 2012/0043081 | A1 * | 2/2012 | Kjorholt | E21B 43/305 166/272.1 |
| 2012/0168182 | A1 | 7/2012 | Hsu et al. | |
| 2013/0043030 | A1 * | 2/2013 | Snider | E21B 43/26 166/308.1 |
| 2013/0048279 | A1 | 2/2013 | Appel et al. | |
| 2013/0228337 | A1 * | 9/2013 | Dombrowski | E21B 43/17 166/308.1 |
| 2015/0096756 | A1 | 4/2015 | Sharma et al. | |

OTHER PUBLICATIONS

Office Action received in Colombian Application No. 15-312593 dated Dec. 16, 2016, 24 pages.

* cited by examiner

METHOD FOR PRODUCING OIL FROM INDUCED FRACTURES USING A SINGLE WELLBORE AND MULTIPLE-CHANNEL TUBING

CLAIM OF BENEFIT TO PRIORITY

This application claims priority to Canadian Patent Application No. 2,820,742, filed Jul. 4, 2013, and to Canadian Patent Application No. 2,835,592 filed Nov. 28, 2013, each of which is hereby incorporated by reference in its entirety.

FIELD OF THE INVENTION

The present invention relates to a method of recovering hydrocarbons from underground hydrocarbon-containing formations. More particularly the present invention relates to method for producing hydrocarbons from a single wellbore using multiple-channel tubing.

BACKGROUND OF THE INVENTION

This background information and document(s) mentioned below is provided for the purpose of making known information believed by the applicant to be of possible relevance to the present invention, and in particular allowing the reader to understand advantages of the invention over methods known to the inventor, but not necessarily public, methods. No admission is necessarily indented, nor should be construed, that CA2,820,742 or figures shown as FIGS. 1-3 herein constitute legally citable prior art against the present invention, and priority is claimed therefrom.

Canadian Patent Application CA 2,820,742 filed Jul. 4, 2013 entitled "Improved Hydrocarbon Recovery Process Exploiting Multiple Induced Fractures", which is commonly assigned with this application, discloses in one aspect thereof a method of providing lateral drive of fluids in a reservoir by injecting fluids into a first set of vertical fractures which extend radially outwardly from a first horizontal well, and producing reservoir fluids from second set of vertical fractures which extend upwardly and radially outwardly from a second horizontal well substantially parallel to the first horizontal well, and which second set of vertical fractures are preferably laterally offset from said first set of vertical fractures, as set out in FIG. 1 of such patent application.

Notably, however, the cost of both drilling and fracturing a pair of (i.e. two) horizontal wells is obviously twice the capital cost if only a single fractured horizontal well was only needed to be used to laterally drive such oil from a region of a reservoir being developed.

CA 2,820,742 further discloses, however, a process for the enhanced recovery of oil from a subterranean reservoir using a lateral drive, and using only a single horizontal production well, having a single set of vertical fractures extending radially outwardly therefrom. In such embodiment an enhanced oil recovery fluid is injected into alternate fractures within the reservoir, and oil which drains downwardly into the horizontal well via the remaining fractures is collected in such horizontal well and thereafter produced to surface, as is shown by the method as depicted in FIGS. 4a-4c and 5a-5c of CA 2,820,742.

Disadvantageously, however, as more fully explained herein, the single horizontal well method as taught in CA 2,820,742 when applied to an open horizontal wellbore (as opposed to a cased horizontal wellbore) and particularly when using gas as the enhanced oil recovery fluid which is injected, will suffer in certain conditions from such injected fluid (gas) bypassing the single packer by travelling through the reservoir immediately adjacent the horizontal wellbore, and thence back into the wellbore thereby bypassing the formation, thereby greatly reducing or eliminating the effectiveness of the gas to drive oil to adjacent hydraulic fractures in the formation, where it can drain down and subsequently be collected.

Accordingly, a real need exists for an effective fluid drive method for sweeping petroleum from an underground reservoir which utilizes a single wellbore and which thus saves capital costs in otherwise having to drill and fracture a second wellbore, but further avoids the problems in the case where the injected fluid is a gas, of bypass as discussed above.

SUMMARY OF THE INVENTION

The invention, which provides an effective solution to each of the aforesaid problems, broadly relates to a method of recovering hydrocarbons from an underground hydrocarbon-containing reservoir having a series of hydraulic fractures therein which extend substantially radially outwardly from a horizontal wellbore within such reservoir, using a "lateral drive" method.

The present method uses an injection fluid which is injected into hydraulic fractures to drive hydrocarbons to adjacent hydrocarbon recovery fractures, which then drain downwardly into a horizontal wellbore and are then recovered.

Importantly, the methods of the present invention each provide for use of a multi-channel tubing, which allows both injection of a driving fluid and recovery of hydrocarbons via separate channels therein. The multi-channel tubing permits the method of the present invention to effectively employ only a single wellbore, and avoids having to incur the cost of drilling further additional wellbores, and further fracturing the formation in the region of same, in order to sweep the reservoir of oil. The multi-channel tubing may be formed into multi-channel continuous or jointed tubing, In a refinement of the above method, the multi-channel tubing used further comprises a further channel, namely a channel for supplying an isolation fluid to an area intermediate an injection fracture and an adjacent hydrocarbon recovery fracture, which isolation fluid in such area thereby prevents or reduces incidence of undesirable "short-circuiting" of injected fluid.

In yet a further refinement, the multi-channel tubing of the present invention possesses yet a further separate channel, namely a further channel for supplying a fluid to actuate hydraulically-actuated packers located along such multi-channel tubing, in the manner as hereinafter described.

Accordingly, in a first broad embodiment of the method of present invention, a method for sweeping a subterranean petroleum reservoir and recovering hydrocarbons therefrom is provided, utilizing a plurality of spaced hydraulic fractures extending radially outwardly from, and spaced laterally along, a length of a single horizontal wellbore drilled through the reservoir. The hydraulic fractures are each in fluid communication with the drilled wellbore. A multi-channel tubing having a plurality of individual discrete channels therein extending along substantially a length thereof is placed in the horizontal wellbore, and at least one packer element situated along a length of said tubing is employed. The plurality of channels in the multi-channel tubing comprise, at a minimum, a fluid injection channel for transmitting a driving fluid to hydraulic fractures in the reservoir, and a separate hydrocarbon recovery channel for collecting hydrocarbons which drain into the reservoir and producing them to surface. Such method further comprises the steps of:

(i) utilizing the at least one packer element on said tubing within the wellbore so as to thereby prevent fluid communication between adjacent pairs of the hydraulic fractures via the wellbore;

(ii) injecting a fluid into the reservoir via at least one of the spaced hydraulic fractures and via the fluid injection channel in the multi-channel tubing, the fluid injection channel having an aperture to allow egress of the fluid from the injection channel, and directing the fluid to flow into at least one of the pair of hydraulic fractures; and (iii) recovering hydrocarbons which drain into an other of the pair of hydraulic fractures via the hydrocarbon recovery channel in the multi-channel tubing, a further aperture being located in the hydrocarbon recovery channel to allow ingress of hydrocarbons into the hydrocarbon recovery channel from the wellbore and from the formation.

As mentioned above, in addition to the two channels in the multi-channel tubing, namely the fluid injection channel and the hydrocarbon recovery channel, the multi-channel tubing of the present invention, may further comprise a packer actuation channel, and the packer comprises at least one hydraulically-actuated packer located along the tubing, wherein the method further comprises:

prior to, or at the time of, injecting the fluid into the fluid injection channel, supplying the fluid or another fluid to the packer actuation channel to actuate the at-least-one packer so as to cause the at-least-one packer to isolate, within the wellbore, the fluid which flows from said fluid injection channel via said aperture from the hydrocarbons which flow into the wellbore.

In the manufacture of such multi-channel tubing, flat sections of steel which divide the interior of a circular tubing into a number of (in cross-section) pie-shaped divisions can be inserted into tubing, and fusion-welded at the contact points of such flat sections with the circular interior of the tubing. Welding at such contact point can be accomplished by various forms of automated fusion welding as well known to those skilled in the art. Alternatively, a smaller tubing or tubings may be placed in a larger tubing without welding to form the multi-channel tubing for uses in the manners, and methods described therein.

Alternatively, one or more smaller diameter tubings may be placed into continous tubing. Welding such smaller diameter tubings to each other, and to the inside of the large diameter tubing, and further create additional discrete channels within the interstitial areas intermediate such smaller diameter tubing and the largest tubing in which each of the smaller diameter tubings are contained within.

In any of the above methods, where the horizontal wellbore used is an open bore wellbore, at least a pair of said packer elements may be provided on the multi-channel tubing which create an isolated area in the wellbore intermediate the pair of hydraulic fractures. In such an embodiment the multi-channel tubing further comprises an isolation channel for supply of an isolating fluid along the isolation channel to the isolated area, and such method further comprises the step of:

prior to, or at the time of injecting the fluid into the fluid injection channel, supplying the isolating fluid to the isolation channel and into the isolated area, to thereby prevent the fluid which has been injected into said reservoir from otherwise "short-circuiting" and flowing back into the wellbore.

Once the above method has been practiced for a time, the method may further comprise:

re-positioning the tubing and the packer element thereon between another adjacent pair of adjacent hydraulic fractures;

utilizing the at-least-one packer on the tubing within the wellbore so as to thereby prevent fluid communication between the another pair of hydraulic fractures via the wellbore;

injecting the fluid into one of the another pair of adjacent hydraulic fractures via the fluid injection channel in the multi-channel tubing; and recovering hydrocarbons from the reservoir which drain into an other of the another adjacent pair of hydraulic fractures, via the hydrocarbon recovery channel in the multi-channel tubing.

It has been recognized that significant time savings can be employed using a refinement of the present method of the invention, wherein the entire reservoir under development is swept simultaneously by injecting fluid into multiple fractures around a single open-bore horizontal well, or alternatively into multiple fractures surrounding a lined and perforated horizontal well. In both scenarios the entire reservoir is swept in the time required to sweep between a single set of fractures.

Accordingly, in a further (second) embodiment, rather than re-positioning the multi-channel tubing for each fluid-injection cycle, the fluid injection may be injected simultaneously along a length of an open-bore horizontal well and into alternatingly-spaced hydraulic fractures which have been created along such wellbore in accordance with well-known wellbore fracturing techniques.

More particularly, such refinement comprises a method for simultaneously sweeping a subterranean petroleum between spaced hydraulic fractures extending radially outwardly and spaced laterally along a horizontal wellbore drilled low in said reservoir, said plurality of hydraulic fractures comprising a plurality of fluid injection fractures alternately spaced along said wellbore with a substantially corresponding number of alternating plurality of hydrocarbon recovery fractures, said hydraulic fractures each in fluid communication with said wellbore, further utilizing a single multi-channel tubing having a plurality of individual discrete channels therein, including a fluid injection channel and a separate hydrocarbon recovery channel and packer elements spaced along a length of said tubing for preventing fluid communication between adjacent hydraulic fractures via said wellbore, which multi-channel tubing is placed within the horizontal wellbore, comprising the steps of:

(i) injecting a fluid into each of said fluid injection fractures via said fluid injection channel in said multi-channel tubing, said fluid injecting channel having first apertures therealong to allow said fluid egress from said fluid injecting channel and to permit said fluid to flow into respective fluid injection fractures; and (ii) recovering hydrocarbons from said reservoir which drain into said hydrocarbon recovery fractures via said separate hydrocarbon recovery channel in said multi-channel tubing, second apertures being located in said hydrocarbon recovery channel therealong to allow ingress of hydrocarbons which flow into said wellbore into said hydrocarbon recovery channel.

In a further refinement of the second embodiment, which substantially avoids problems of "bypass", a pair of the packers on the tubing are employed to create an isolated area in the wellbore intermediate the pair of hydraulic fractures, and the multi-channel tubing further comprises an isolation channel for supply of an isolating fluid along said isolation channel to the isolated area to thereby prevent said fluid which has been injected into said reservoir flowing back into the wellbore at the location of the isolated area.

In a third embodiment of the method of the present invention, a lined and cemented wellbore is used instead of an open-hole wellbore, which has the advantage in that half the number of packers is needed in comparison to the aforementioned second embodiment where an open hole is used. Also, the multi-channel tubing can avoid having to devote a separate channel for providing an isolating fluid to the isolated area, as problems of 'bypass" of injected fluid back into the wellbore at locations along the wellbore is substantially avoided by use of a cased and cemented wellbore. Such not only simplifies the multi-channel tubing construction, thereby further reducing manufacturing costs, but further allow, in a tubing of limited diameter, greater cross-sectional area of the remaining channels thereby increasing the fluid-carrying capacity of each of the remaining channels.

Accordingly, in a further (third) embodiment, a method for simultaneously sweeping a subterranean petroleum reservoir between spaced hydraulic fractures extending radially outwardly and spaced laterally along a cased horizontal wellbore drilled low in said formation, and which has a perforated liner therein, is provided. The plurality of hydraulic fractures comprise a plurality of fluid injection fractures alternately spaced along said wellbore with a substantially corresponding number of alternating hydrocarbon recovery fractures, said hydraulic fractures each in fluid communication with said wellbore, further utilizing a single multi-channel tubing having a plurality of individual discrete channels therein, including a fluid injection channel and a separate hydrocarbon recovery channel and packer elements spaced along a length of said tubing for preventing fluid communication between adjacent hydraulic fractures via said wellbore, which multi-channel tubing and packer elements thereon is placed within the horizontal wellbore, comprising the steps of:

(i) drilling a horizontal wellbore through said reservoir, in a substantially lower portion of said reservoir;

(ii) inserting a liner in said wellbore, wherein said liner is perforated in specific intervals corresponding to a location of said spaced hydraulic fractures along said wellbore, or perforating said liner and forming said spaced hydraulic fractures along said wellbore;

(iii) inserting said multi-channel tubing in said wellbore, (iv) injecting a fluid into said reservoir via each of said spaced hydraulic fractures and via said fluid injection channel, said fluid injecting channel having first apertures therealong to allow said fluid egress from said fluid injecting channel tubing and to permit said fluid to flow into said fluid injection fractures; and (v) recovering hydrocarbons which drain into said hydrocarbon recovery fractures via said separate hydrocarbon recovery channel in said multi-channel tubing, said hydrocarbon recovery channel having second apertures spaced therealong to allow ingress of hydrocarbons which flow into said wellbore via respective of said hydrocarbon recovery fractures into said hydrocarbon production channel.

In a further refinement of each of the second and third embodiments disclosed above, the multi-channel tubing may further comprise a packer actuation channel, and said packers comprise hydraulically-actuated packer, and the method further comprises:

prior to, or at the time of, injecting said fluid into said fluid injection channel, supplying said fluid or another fluid to said packer actuation channel to actuate said packers so as to cause said packers to preventing fluid communication between adjacent hydraulic fractures via said wellbore.

In any of the foregoing embodiments, the first and/or second apertures in the multi-channel tubing may be created at surface and prior to insertion of said tubing in said wellbore.

For all three (3) embodiments, optimal reservoir sweep is attained when all the fractures are evenly spaced and the reservoir has homogeneous permeability and fluid saturations—the "ideal" reservoir. Nevertheless, as long as the locations of the fractures are known (and thus the apertures in the channels can accordingly be located, namely the first aperture(s) in the fluid injection channel for allowing egress of the injecting fluid to pass into the fluid injection fractures, and the second apertures in the hydrocarbon recovery channels for collecting hydrocarbons which drain from the hydrocarbon recovery fractures), the multi-channel tubing can be prepared at the surface prior to insertion into the hole.

For the second and third embodiments where fluid recovery fractures are alternately spaced with a fluid recovery fractures, apertures in the multi-channel tubing are created alternately into the fluid injection channel and the fluid recovery channel in the appropriate longitudinal locations and inflatable packers placed on either side. An optional third channel, having apertures directly opposite the packers to provide a means of inflation of the packers using fluid in a packer supply channel, may be provided. Where a fourth isolation channel is provided, as in the second embodiment, additional apertures may be drilled or formed in such channel, alternatingly spaced with the apertures created in the fluid supply channel and hydrocarbon recovery channel, to allow supply isolation fluid to the wellbore intermediate the packers, to prevent injected fluid which is injected into the fluid injection fractures from "bypassing" the formation and flowing back into the open wellbore intermediate the packers provided.

In any of the foregoing embodiments, the isolating fluid may comprise water, a non-combustible gas, or a viscous liquid.

In any of the foregoing embodiments, the injected fluid may comprise water, oil, steam, a non-combustible gas, or an oxidizing gas. In a preferred embodiment the injected fluid is an oil, or a gas which is miscible or immiscible in oil.

BRIEF DESCRIPTION OF THE DRAWINGS

The accompanying drawings illustrate one or more exemplary embodiments of the present invention and are not to be construed as limiting the invention to these depicted embodiments. The drawings are not necessarily to scale, and are simply to illustrate the concepts incorporated in the present invention.

DETAILED DESCRIPTION OF PREFERRED EMBODIMENTS

Figure 1:
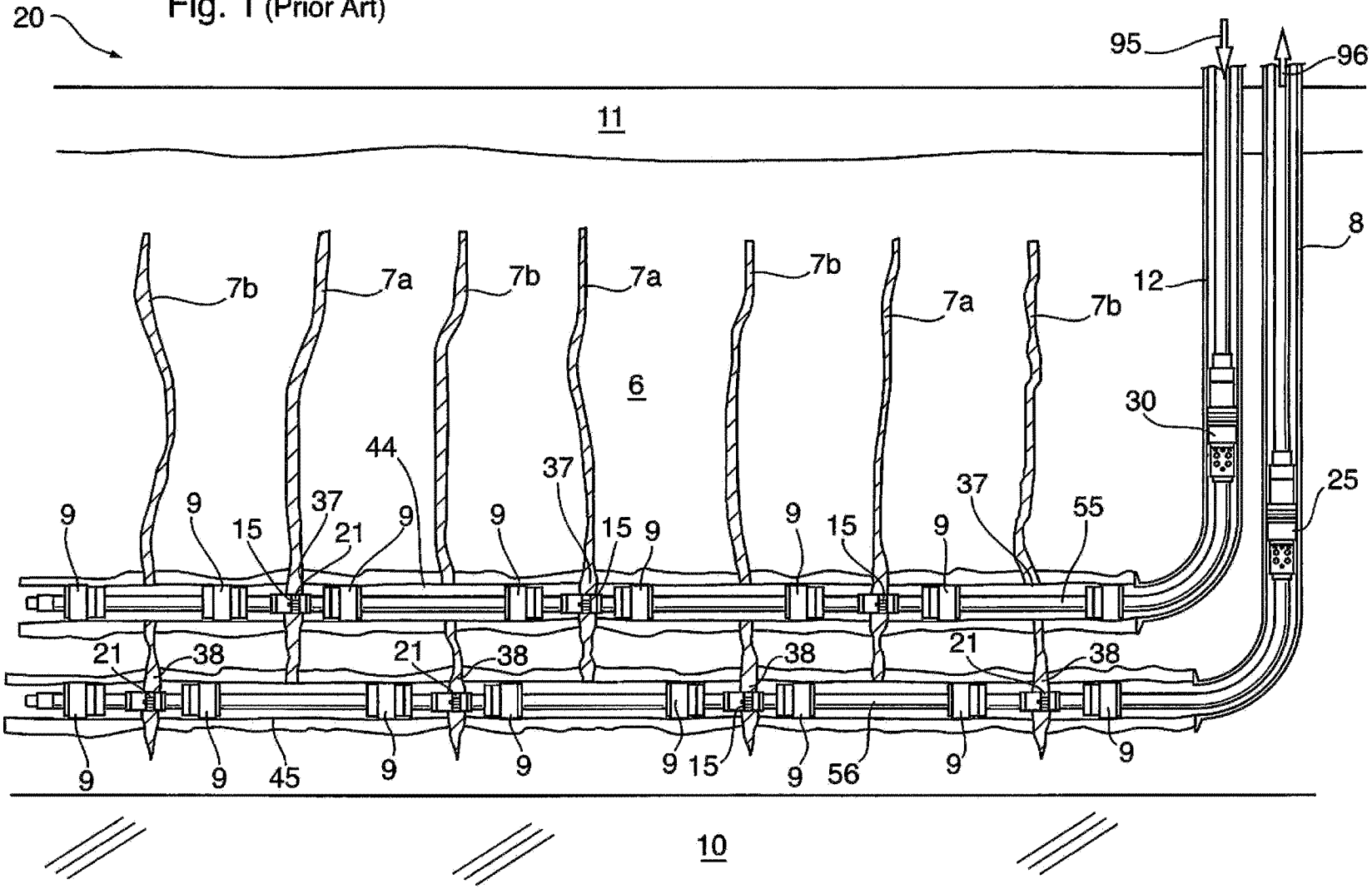
Fig. 1 (Prior Art)
FIG. 1 is a depiction of one of the methods taught in CA 2,820,742 and which depicts a method of using alternating injection and collection fractures extending, respectively from a pair of horizontal wells, which disadvantageously uses/requires two (2) horizontal wells for carrying out such method.

With reference to the drawings FIGS. 1-9 and the reference numeral indicated therein, like elements are designated by identical reference numerals.

FIG. 1 shows a method 20 as taught in CA 2,820,742, which utilizes two (2) horizontal wellbores 44, 45 for sweeping a hydrocarbon-containing reservoir 6 of hydrocarbons, typically heavy or light oil. Such hydrocarbon-containing reservoir 6 is typically located between upper cap rock 11, and bottom rock 10. Each of wellbores 44, 45 extend horizontally outwardly from respective vertical portions 8, 12.

A series of hydraulic fissures 7*a* are created along horizontal wellbores 44 by perforating a casing at location 37, or simply injecting a fluid at located 37 along wellbore 44.

Similarly, series of hydraulic fissures 7*b* are created along horizontal wellbores 45 by perforating a casing at location 38, or simply injecting a fluid at located 38 along wellbore 45.

Injection tubing 55, having packers 9 on either side of apertures 15 therein, is inserted in wellbore 44, and hung by tubing hanger 30, and the apertures 15 therealong aligned with corresponding fractures 7*a* situated along wellbore 44.

Likewise, tubing 56, having packers 9 on either side of apertures 21 therein. is inserted within wellbore 45 and hung by tubing hanger 25, and the apertures 21 therealong aligned with corresponding fractures 7*b* situated along wellbore 45.

Thereafter, an injection fluid 95, such as a solvent, heated steam, or a gas which is miscible in oil such as $CO_2$, is injected in tubing 55, which fluid 95 then enters the reservoir 6, where such fluid reduces the viscosity of heavy hydrocarbons therein and through gravity and pressure differential causes such heavy hydrocarbons to be "driven" towards hydrocarbon recovery fractures 7*b* where they then drain downwardly and enter hydrocarbon recovery tubing 56 via apertures 21 therein, and such heavy hydrocarbons 96 are subsequently produced to surface via production tubing 56.

Disadvantageously, such method of FIG. 1 requires the drilling and fracturing of two (2) horizontal wells, which greatly adds to the capital cost of such recovery method.

Figure 2:
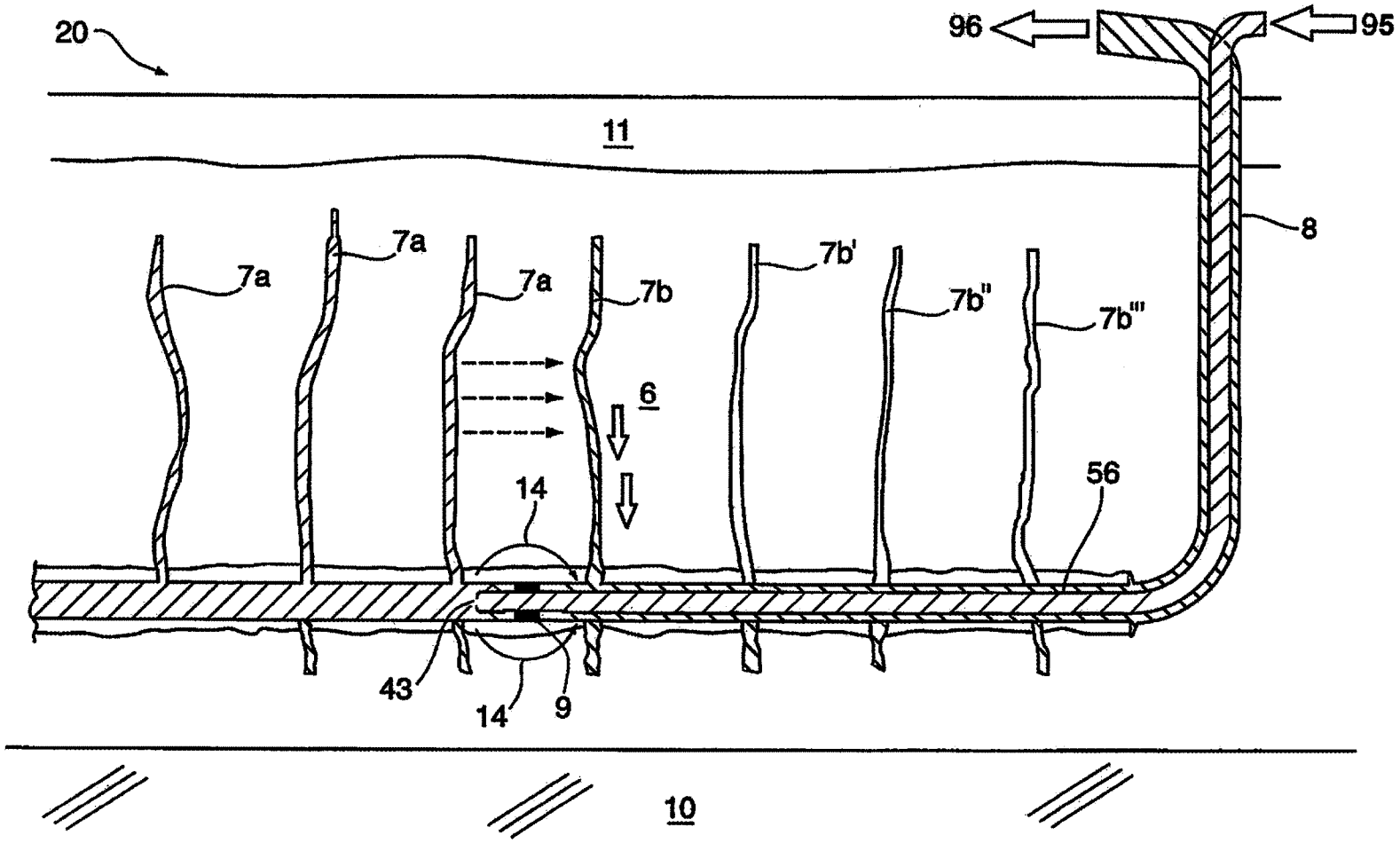
Fig. 2 (Prior Art)
FIG. 2 is a depiction of another of the methods taught in CA 2,820,742 for sweeping a reservoir of oil, which teaches using a single horizontal wellbore and a plurality of hydraulic fractures within the formation, wherein fluid which is injected in one fracture causes oil in a portion of the reservoir closest an adjacent fracture to migrate and drain into such recovery fracture and hence downwardly into the horizontal wellbore. Tubing used for fluid injection single tubing, and after injection and recovery from a first pair of fractures is thereafter repositioned to inject into the fracture from which oil was previously recovered and to recover further oil from an adjacent additional hydraulic fracture. Such method, as mentioned, disadvantageously suffers, when the injected fluid is a gas, from problematic "short-circuiting" or "bypassing" of the injected fluid from point of injection to the point of collection without driving oil to the collection fractures.
Figure 3:
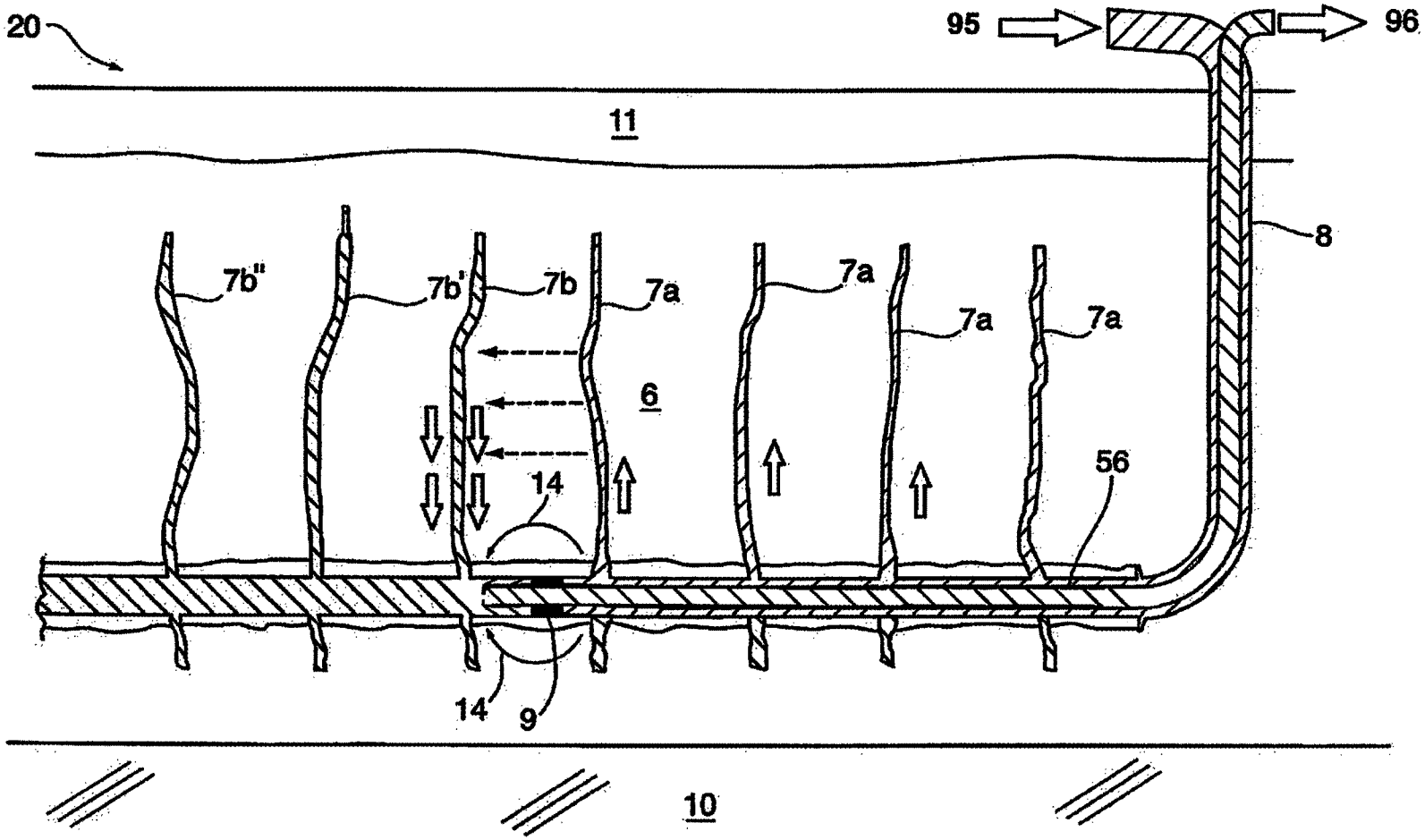
Fig. 3 (Prior Art)
FIG. 3 is a depiction of another of the methods taught in CA 2,820,742 for sweeping a reservoir of oil, which likewise teaches use of a single horizontal wellbore, and which likewise disadvantageously suffers, when the injected fluid is a gas, from problematic "short-circuiting" or "bypassing" of the injected fluid from point of injection to the point of collection without driving oil to the collection fractures.

FIG. 2 & FIG. 3 likewise show two similar methods 20 as disclosed in CA 2,820,742 for sweeping a reservoir 6 of heavy hydrocarbons, which are typically (but not necessarily) situated between cap rock 11 and bottom rock 10. In each, a series of hydraulic fractures 7*a*, 7*b*, 7*b*', 7*b*", 7*b*", and 7*b*'" are created along wellbore 8. A single packer 9 is located at an end of tubing 56, which is used to isolated injection fluid 96 from recovered hydrocarbons 96.

In the case of the method 20 of FIG. 2, an injection fluid 96, as described above, is injected via tubing 56 and into a fluid injection fracture(s) 7*a*, after exiting the tip 43 of tubing 56 where such fluid in region of the depicted arrows of formation 6 drives hydrocarbons towards hydrocarbon recovery fracture 7*b*, where it drains downwardly and flows into wellbore 8, where it is then produced to surface via an annular region between tubing 56 and wellbore. Thereafter, tubing 56 is pulled uphole an incremental distance so as to position packer 9 between a next adjacent pair of hydraulic fractures 7*b* and 7*b*', and injection fluid 95 now injected into fracture 7*b* and heavy oil then driven to fracture 7*b*' and after draining into wellbore 45, produced to surface. The process is repeated until reservoir 6 has been completely swept of heavy oil and the oil 96 therein recovered in the above manner.

In the case of the method 20 of FIG. 3, an injection fluid 95, as described above, is injected via wellbore 8 and into a fluid injection fracture(s) 7*a*, where such fluid drives hydrocarbons towards hydrocarbon recovery fracture 7*b*, where such hydrocarbons drains downwardly and flows into tubing 56, where it is then produced to surface. Thereafter, tubing 55 is pushed downhole an incremental distance so as to position packer 9 between a next adjacent pair of hydraulic fractures 7*b* and 7*b*', and injection fluid 95 now injected into fracture 7*b*, and heavy oil then driven to fracture 7*b*' and after draining into tubing 56 is produced to surface. The process is repeated until reservoir 6 has been completely swept of heavy oil and the oil 96 therein recovered in the above manner.

Each of the aforesaid methods 20 of FIG. 2 & FIG. 3 suffer from, in certain circumstances, injection fluid "bypassing" the reservoir by flowing in the direction of arrows 14, so as to undesirably flow into wellbore 8 (in the case of FIG. 2) or into tubing 56 (in the case of FIG. 3), and thereby bypassing flow into the reservoir 6 and thus not fulfilling its intended role as a driving fluid to drive heavy into such respective hydrocarbon recovery fractures 7*b*,7*b*', 7*b*" as the case may be for recovery.

Figure 4:
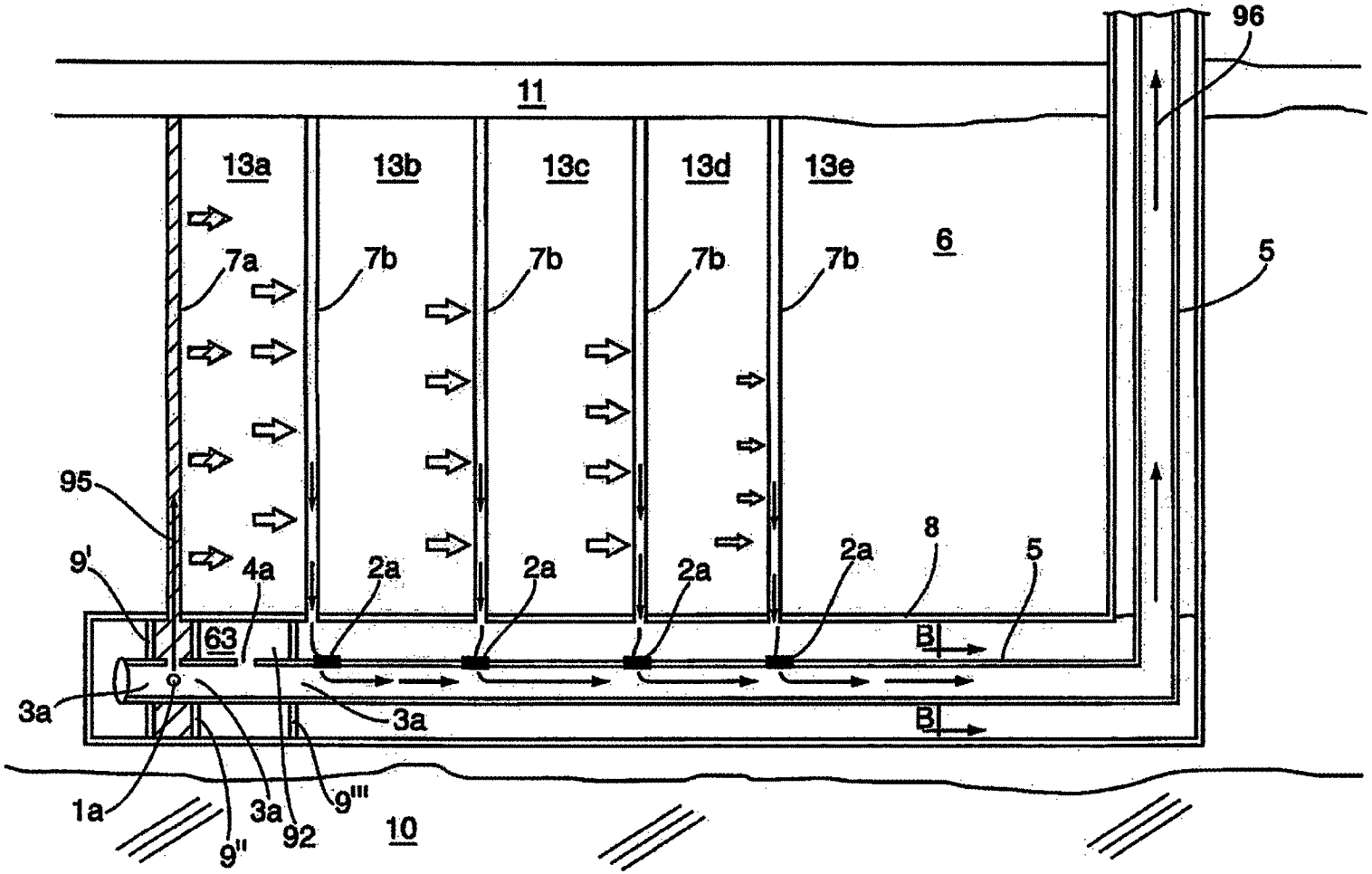
FIG. 4 is a depiction of one of the methods of the present invention, namely a first embodiment thereof which uses a series of hydraulic fractures and a single horizontal wellbore, and which further utilizes a multi-channel tubing to both deliver an injection fluid and to recover hydrocarbons which drain into the wellbore.

Accordingly, to overcome the aforesaid disadvantages, the present method in one of its broad embodiments shown in FIG. 4, comprises a method for sweeping a subterranean petroleum reservoir 6 and recovering hydrocarbons 96 therefrom. Such method utilizes a plurality of spaced hydraulic fractures 7*a*, 7*b* extending radially outwardly from, and spaced laterally along, a length of a single horizontal wellbore 8 drilled through the reservoir 6. The hydraulic fractures 7*a*, 7*b* are each in fluid communication with the drilled wellbore 8.

Figure 5:
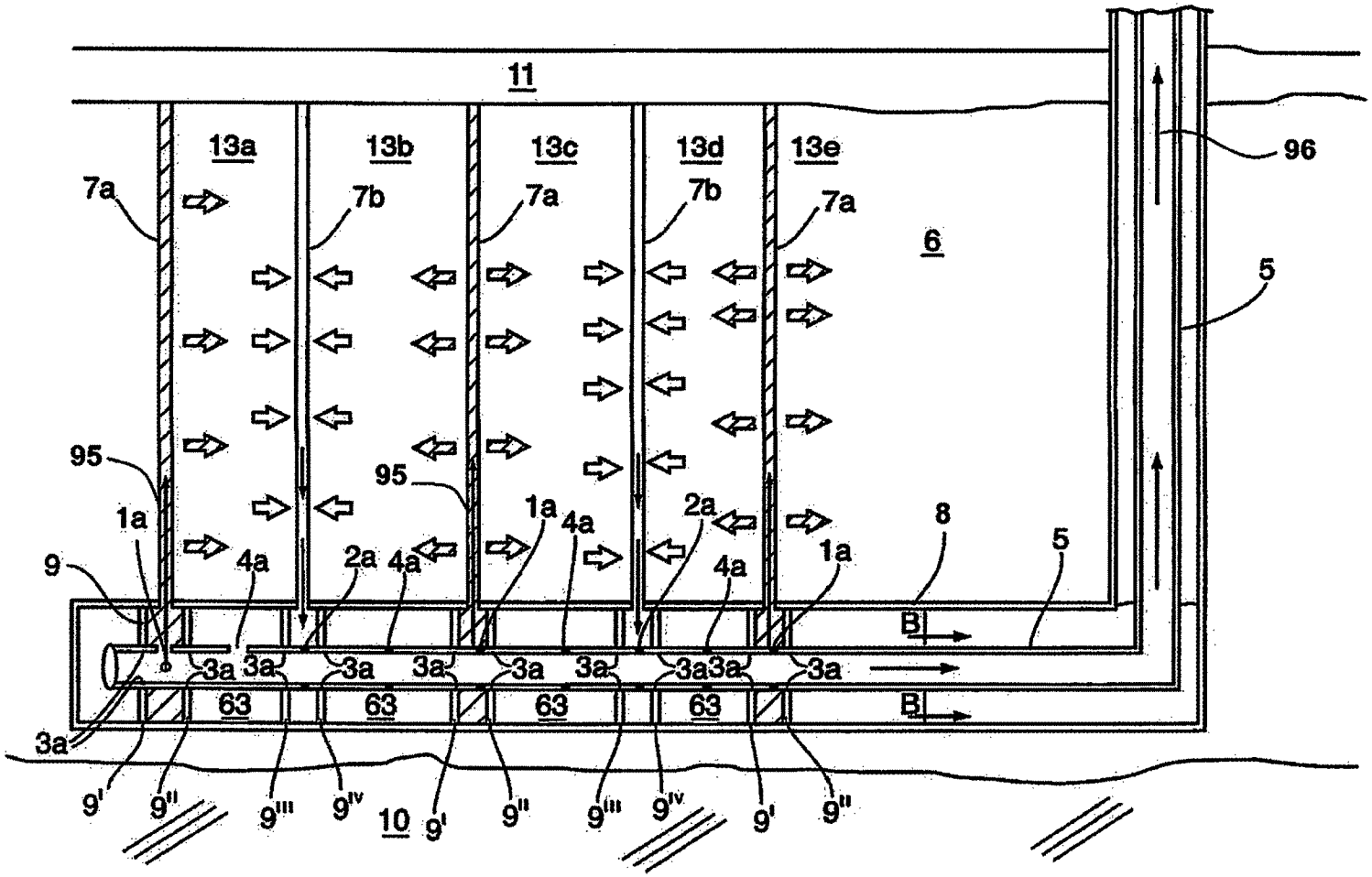
FIG. 5 is a depiction of a second embodiment of the present invention, using an open (uncased) wellbore and a series of alternately-spaced injection and collection fractures within the reservoir, further utilizing a multi-channel tubing to both deliver an injection fluid and to recover hydrocarbons which drain into the wellbore.
Figure 6:
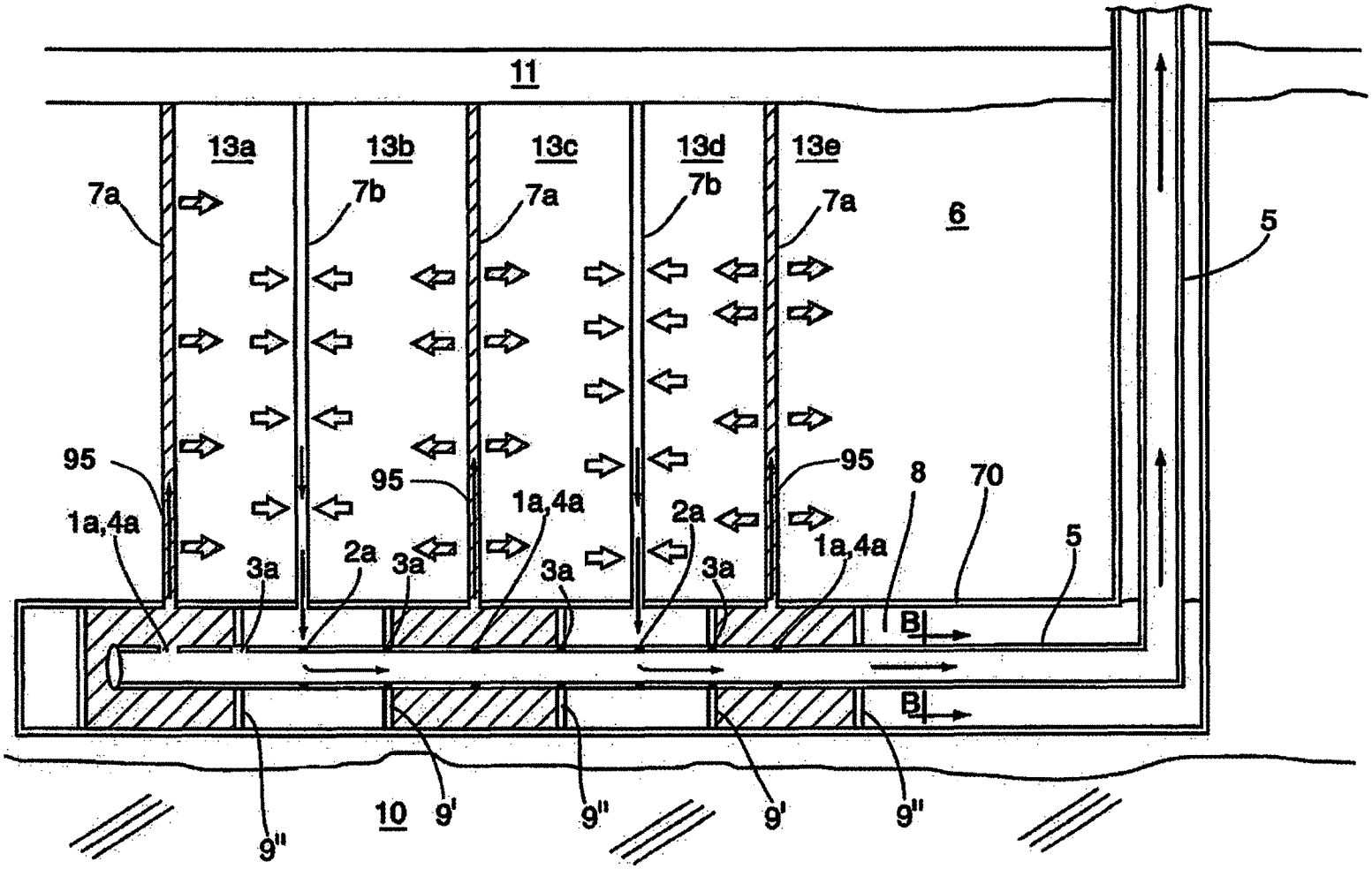
FIG. 6 is a depiction of a third embodiment of the present invention, using a cased horizontal wellbore, and a series of alternately-spaced injection and collection fractures within the reservoir, further utilizing a multi-channel tubing to both deliver an injection fluid and to recover hydrocarbons which drain into the wellbore.
Figure 7B:
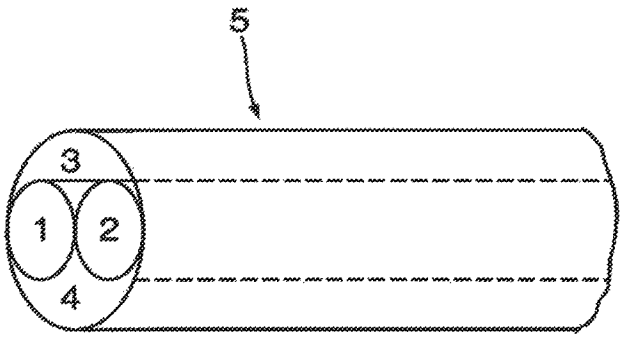
FIG. 7B is a perspective view of the multi-channel tubing in FIG. 7A.
Figure 8B:
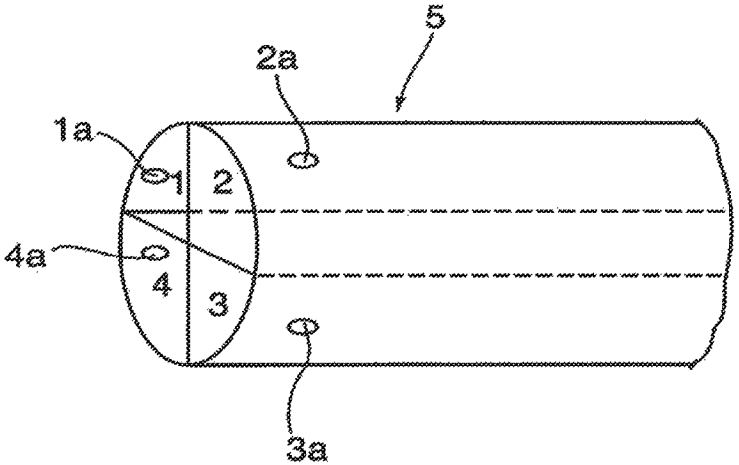
FIG. 8B is a perspective view of the multi-channel tubing in FIG. 7A.
Figure 7A:
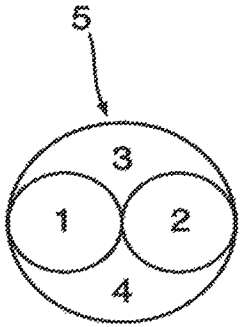
FIG. 7A is a cross-sectional view of one embodiment of the multi-channel tubing of the present invention, taken along plane 'B'-'B' of each of FIGS. 4, 5, & 6.
Figure 8A:
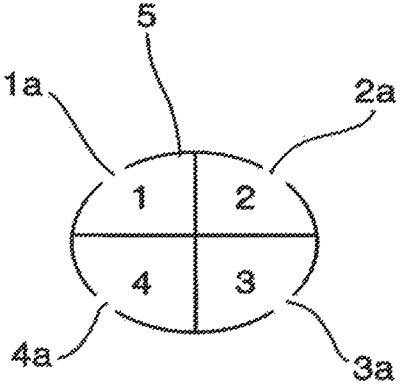
FIG. 8A is a cross-sectional view of another embodiment of the multi-channel tubing of the present invention, taken along plane 'B'-'B' of each of FIGS. 4, 5, & 6.

A multi-channel tubing 5 having a plurality of individual discrete channels therein (see fluid injection channel 1, hydrocarbon recovery channel 2, packer actuation channel 3, and isolation channel 4 shown in FIG. 7A and FIG. 8A which are each alternative cross-sections taken along plane B-B of FIGS. 4-6) is provided. Discrete channels 1, 2, 3, 4 in multi-channel tubing 5 extend along substantially a length of tubing 5. Such tubing 5 is placed in horizontal wellbore 8.

At least one packer element 9 is situated along a length of tubing 5, to prevent bypass flow of injection fluid 96 along wellbore 8 from fluid injection aperture 1*a* to fluid recovery aperture 2*a*. The plurality of channels in the multi-channel tubing 5 comprise, at a minimum, a fluid injection channel 1 for transmitting a driving fluid to hydraulic fractures in the reservoir 6 via a fluid injection channel 7*a*, and a separate hydrocarbon recovery channel 2 for collecting hydrocarbons 95 which drain into the reservoir 6 and producing them to surface.

Apertures 1*a*, 2*a*, 3*a*, and 4*a*, as best shown in partial cross-sectional isometric views in FIG. 7B, FIG. 8B are provided at appropriate points along length of tubing 5 (ref. FIG. 4) to allow fluid communication with an exterior of a given channel 1, 2, 3, 4 at a desired position along length of channel 5 with only one or selected of associated channels 1, 2, 3, and 4.

Figure 9:
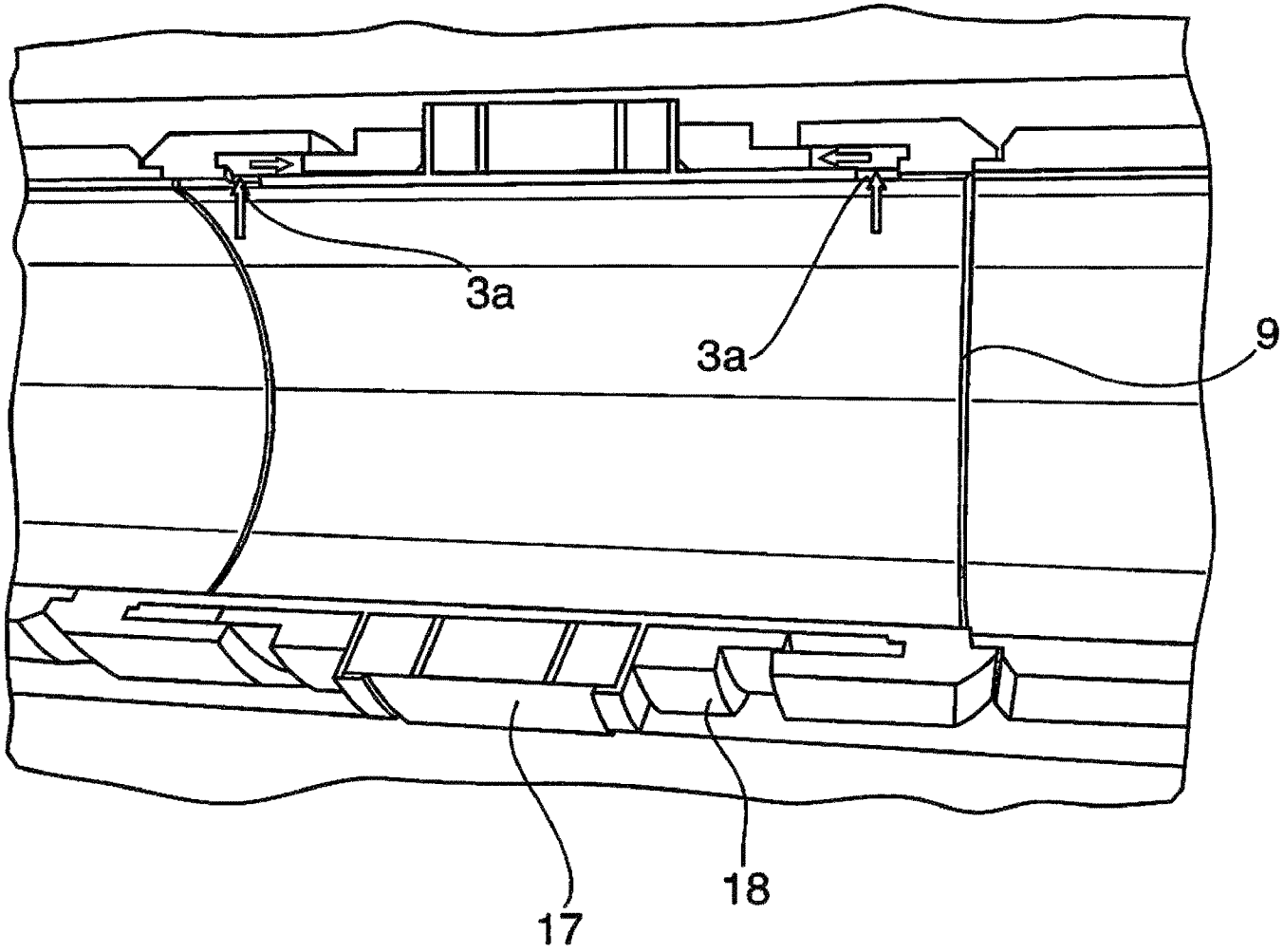
FIG. 9 is a partial sectional cross-sectional view of a hydraulically-actuated packer element used in the methods of the present invention.

In the embodiment shown in FIG. 4, three packer elements 9', 9", and 9"', of the type of packer element shown in FIG. 9 and commonly employed in the fracking industry and as manufactured by Packers Plus Inc. of Calgary, Alberta, Canada, are employed-the two packer elements 9', 9" proximate distal end of wellbore 8 being used to ensure injection fluid 95 injected into fluid injection channel 1 and egressing therefrom via associated aperture 1*a* is directed into fluid injection fracture 7*a*.

In the embodiment shown in FIG. 4, a third packer 9"', initially located on tubing 5 below region 13*a*, is used to provide, between packer element 9" and 9"', an isolation area 63, which may be supplied with an isolation fluid via an aperture/port 4*a* in tubing 5, to act as a barrier to prevent flow of injection fluid entering reservoir 6 from flowing back into wellbore 8, and not as intended into region 13*a* to otherwise reduce the viscosity of heavy oil in region 13*a*, and drive same, through a pressure differential, into hydrocarbon recovery fracture 7*b*, where is enters wellbore 8 and via aperture 2*a* in hydrocarbon recovery channel 2, is thereby able to be produced to surface.

The packers 9, 9' may be actuated by the fluid injection fluid 95, and packer 9" actuated by isolation fluid 92, as contemplated in FIG. 4.

Alternatively, an additional packer actuation channel 3 may be incorporated in tubing 5, along with an associated apertures 3*a* proximate such packers 9', 9", and 9"' located along tubing 5 thereon. In such alternative configuration/manner packers 9', 9", and 9"' may be separately actuated by supplying fluid under pressure directly to such packers 9', 9", and 9"' via packer actuation channel 3.

To conduct a hydrocarbon sweeping operation in accordance with the method depicted in FIG. 4, after insertion of tubing 5 in wellbore 8 and actuation of packers 9', 9", and 9"' on tubing 5, and further after injection of isolating fluid into channel 4 and thus into the isolation region in wellbore 8 intermediate packers 9" and 9"', fluid 95 is injected into fluid injection channel 1 and thus into formation 6. Such injected fluid 95 then drives hydrocarbons in region 13*a* into associated hydrocarbon recovery fracture 7*b*, and thence into hydrocarbon recovery channel 2 via aperture 2*a* located in the exterior of tubing 5.

After a time and when the rate of hydrocarbons draining into fracture 7*b* slows significantly or stops, fluid injection into channel 1, 3, and 4 is ceased, resulting in the packers 9', 9", and 9"' becoming deactivated. The distal end of tubing 5 is then repositioned beneath region 13*b*. The above process is then successively repeated until substantially all heavy hydrocarbons in regions 13*b*, 13*c*, 13*d*, and 13*e* have been swept into recovery channel 2 and produced to surface. Thereafter, fluid injection is terminated, all the packers 9', 9", 9"', are collapsed and the reservoir 6 is operated under pressure drawdown FIG. 5 depicts a method of the present invention for simultaneously sweeping a subterranean petroleum reservoir 6, and in particular a reservoir 6 in which is penetrated by an uncased "open" wellbore 8, having a cap rock 11, a bottom rock 10, and multiple induced hydraulic fractures 7*a* and 7*b* along the length of wellbore 8, further having regions 13*a*, 13*b*, 13*c*, 13*d* situated between alternating fluid injection fractures 7*a* and hydrocarbon recovery fractures 7*b*. The multi-channel tubing 5 contains four (4) channels internally as shown in FIGS. 7A,7B or FIGS. 8A,8B, namely a fluid injection channel 1, a hydrocarbon recovery channel 2, a packer actuation channel 3, and a isolation channel 4. Injection fluids are delivered via channel channels 1, 3 and 4 and production of reservoir fluids 96 occurs through channel 2. Channel 1 delivers the enhanced oil recovery fluid simultaneously into each of fractures 7*a*, while channel 2 provides drainage of reservoir fluids 95 from fractures 7*b*. Channel 3 provides a fluid to the expandable packers 9', 9", and 9"', via perforations 3*a* in tubing 5. Channel 4 provides fluid through perforations 4*a* in tubing 5 to isolated areas 63.

In the embodiment shown in FIG. 5, pairs of packer elements 9', 9" are located along tubing 5 to isolate injection fluid 95 being supplied to fluid injection fractures 7*a*. Similarly pairs of packer elements 9", $9^{iv}$ are located along tubing 5 to isolate injection fluid 95 being supplied to fluid injection fractures 7*b*. An isolation area 63, which is thusly created between pairs of packer elements 9', 9" and 9"', $9^{iv}$, may be supplied with an isolation fluid via an aperture/port 4*a* in tubing 5, to act as a barrier to prevent flow of injection fluid 95 from flowing back from reservoir 6 into wellbore 8, and not as intended into regions 13*a*, 13*b*, 13*c*, 13*d*, and 13*e* to otherwise reduce the viscosity of heavy oil in such regions and drive same, through a pressure differential, into hydrocarbon recovery fractures 7*b*, where such heavy oil then enters wellbore 8 and via aperture 2*a* in hydrocarbon recovery channel 2, is thereby able to be produced to surface.

The packers 9', 9" and 9'", 9$^{iv}$ may be actuated by the fluid injection fluid 95, in which case multi-channel 3 need not be used or provided for. Alternatively, as shown in the embodiment shown in FIG. 5, a packer actuation channel 3 may be incorporated in tubing 5, which channel 3 along with an associated apertures 3*a* located proximate packers 9', 9", 9'" and 9$^{iv}$ along tubing 5, allows packers 9', 9", 9'" and 9$^{iv}$ to all be simultaneously actuated by supplying fluid under pressure directly to such packers 9', 9", 9'" and 9$^{iv}$ via packer actuation channel 3.

To conduct a simultaneous hydrocarbon sweeping operation of in accordance with the method depicted in FIG. 5, after insertion of tubing 5 in wellbore 8 and actuation of packers 9', 9'" and 9$^{iv}$ by injection of fluid into packer isolation channel 3 in the manner described above, and further after injection of isolating fluid into channel 4 and thus into the isolation regions 63 in wellbore 8, fluid 95 is injected into fluid injection channel 1 and thus into formation 6 via each of fluid injection fractures 7*a*. Injected fluid 95 then drives hydrocarbons in regions 13*a*, 13*b*, 13*c* and 13*d* into associated hydrocarbon recovery fractures 7*b*, and thence into hydrocarbon recovery channel 2 via apertures 2*a* located in the exterior of tubing 5 and along the length of tubing 5 in the positions shown in FIG. 5.

After a time and when the rate of hydrocarbons draining into fractures 7*b* slows significantly or stops, fluid injection into channels 1 & 3 is ceased, and reservoir 6 is operated under pressure drawdown, or alternatively tubing 5 and associated packers 9', 9", 9'" and 9$^{iv}$ withdrawn from wellbore 8 for deployment elsewhere.

FIG. 6 depicts a method of the present invention for simultaneous sweeping a subterranean petroleum reservoir 6 similar to the method depicted in FIG. 5, but in the case of FIG. 6 such method is adapted for use in association with a wellbore 8 which is lined with a perforated liner 70 or a liner 70 which is subsequently perforated at known intervals/locations. This method, although it requires a perforated liner 70, has advantages over the method of FIG. 5 in that the problem of injected fluid 95 bypassing isolation packers 9', 9" via the reservoir 6 and flowing into the wellbore 8 (as heretofore described) cannot occur because the tubing 5 is isolated from the reservoir 6 and regions 13*a*, 13*b*, 13*c*, 13*d*, and 13*e* by the liner 70. This importantly results in an advantage in reducing the number of packers 9 required, and in particular, as compared to the method of FIG. 5, reducing the number of packers 9 by one-half. This is a significant consideration since inflatable packers are relatively expensive. In addition, one less channel (i.e. isolation channel 4) is accordingly no longer needed, thereby potentially, for a similar sized wellbore 8, allowing the relative cross-sectional areas of remaining channels 1, 2 (and optionally 3) to thereby be increased thereby increasing flow therethrough.

In the embodiment of the method shown in FIG. 6 and with reference to cross-section B-B through FIG. 6 as shown in FIG. 7A or alternatively 8A, pairs of packer elements 9', 9" on multi-channel tubing 5 are deployed in wellbore 8 on opposite sides of an injection fracture 7*a*, automatically resulting in regions of the wellbore 8 proximate hydrocarbon recovery fractures 7*b* likewise being bounded on either side by isolation packers 9", 9'.

To conduct a simultaneous hydrocarbon sweeping operation in accordance with the method depicted in FIG. 6, after insertion of multi-channel tubing 5 in wellbore 8 and actuation of pairs of packer elements 9', 9" by injection of fluid into packer actuation channel 3 in the manner described above, fluid 95 is injected into fluid injection channel 1 (and also into channel 4 since isolation channel 4 is no longer needed and can be eliminated by combining with channel 1 into a single channel, or used to also supply fluid injection fractures 7*a* as shown in FIG. 6) and thus into formation 6 via each of fluid injection fracture ports 1*a*, 4*a*. Injected fluid 95 then drives hydrocarbons in formation 6 into corresponding adjacent hydrocarbon recovery fractures 7*b*, and thence into hydrocarbon recovery channel 2 via apertures 2*a* located in the exterior of tubing 5 along the length of tubing 5 in the positions shown in FIG. 6.

After a time and when the rate of hydrocarbons draining into fractures 7*b* slows significantly or stops, fluid injection into channels 1 & 3 is ceased and reservoir 6 is operated under pressure drawdown, or alternatively tubing 5 and associated packers 9', 9" is withdrawn from wellbore 8 for deployment elsewhere.

FIGS. 8A, 8*b* are schematics of a first embodiment of a multi-channeled tubing 5 used in the present invention. In this case there are four channels 1,2,3, & 4, but this is not a limiting aspect. For other purposes or applications, the tubing could have a number of channels ranging from two to four or more. In the manufacture, flat sections of steel can be welded into the internal pattern and then inserted into the tubing 5. Welding at the contact points with the tubing 5 can be accomplished by fusion welding, which is well known to those skilled in the art.

In an alternative embodiment, illustrated in FIGS. 7A, 7B, two smaller tubings, 1 and 2, are placed inside a larger tubing, 5 and fusion-welded at the contact points, creating four (4) isolated channels 1,2,3, & 4 within the larger tubing 5.

Tubing 5, containing the internal channels 1,2,3,4, is placed in the wellbore 8 after fracturing the reservoir 6. The advantage of having all of the channels 1, 2, 3, 4 inside a single tubing 5 is that segments of the wellbore 8 outside the tubing 5 can be isolated from each other by standard packers 9 (ref. FIG. 9) extending to the wall of the horizontal wellbore 8. Apertures 1*a*, 2*a*, 3*a*, 4*a* are established between the larger tubing 5 and the respective internal channels 1, 2, 3, 4 at locations on the tubing 5 proximate the location of the fractures 7*a*, 7*b* in wellbore 8.

FIG. 9 depicts a packer element 9 of a type contemplated for use in the various embodiments of the present invention. Such packer 9 may typically be threaded at each end into jointed pipe, where such pipe comprises the multi-channel tubing 5 of the present invention, or may be welded into sections of continuous multi-channel tubing 5. Such packer element 9 contains at least one aperture 3*a* for allowing pressurized fluid to actuate a piston 18 to thereby compress in a longitudinal direction (and thereby expand in a radial direction) an elastomeric element 17 thereon to thereby actuate such packer element 9.

The scope of the claims should not be limited by the preferred embodiments set forth in the foregoing examples, but should be given the broadest interpretation consistent with the description as a whole, and the claims are not to be limited to the preferred or exemplified embodiments of the invention.

The invention claimed is:

1. A method for sweeping a subterranean petroleum reservoir by injecting a fluid into the subterranean petroleum reservoir via a plurality of dedicated fluid injection fractures and simultaneously recovering hydrocarbons from said subterranean petroleum reservoir via a plurality of dedicated hydrocarbon recovery fractures, wherein each of said dedicated fluid injection fractures and said dedicated hydrocarbon recovery fractures extend substantially radially outwardly from and are spaced laterally along a horizontal well bore drilled low in said petroleum reservoir, wherein a total number of said dedicated fluid injection fractures substantially corresponds to a total number of said dedicated hydrocarbon recovery fractures, wherein said dedicated fluid injection fractures and said dedicated hydrocarbon recovery fractures are alternately spaced along said wellbore, wherein said dedicated fluid injection fractures and said dedicated hydrocarbon recovery fractures are each in fluid communication with said wellbore, further utilizing a single multi-channel tubing having a plurality of individual discrete channels therein including a dedicated fluid injection channel and a separate dedicated hydrocarbon recovery channel and spaced packer elements spaced along a length of said multi-channel tubing for preventing fluid communication between adjacent pairs of said dedicated fluid injection fractures and said dedicated hydrocarbon recovery fractures via said wellbore, wherein said multi-channel tubing and said packer elements thereon are placed within the horizontal wellbore, comprising the steps of:

(i) drilling a horizontal wellbore through said reservoir, in a substantially lower portion of said reservoir;

(ii) inserting a hollow liner in said wellbore, wherein said liner possesses spaced perforations therein at specific intervals along a portion of a length thereof corresponding to respective locations of said dedicated fluid injection fractures and said dedicated hydrocarbon recovery fractures along said wellbore, or alternatively perforating said liner after inserting said liner in said wellbore and forming said dedicated fluid injection fractures and said dedicated hydrocarbon recovery fractures along said wellbore at locations of said spaced perforations in said liner, or alternatively perforating said liner after inserting same in said wellbore at locations of said dedicated fluid injection fractures and said dedicated hydrocarbon recovery fractures previously formed along said wellbore;

(iii) inserting said multi-channel tubing in said liner so as to align said spaced packer elements thereon on either side of each individual perforation of said spaced perforations in said liner;

(iv) actuating said spaced packer elements so as to create a seal between said multi-channel tubing and said liner in said wellbore and thereby prevent said fluid communication between said adjacent pairs of said dedicated fluid injection fractures and dedicated hydrocarbon recovery fractures via said hollow liner;

(v) injecting a fluid into said reservoir via each of said dedicated fluid injection fractures and via said fluid injection channel, said fluid injection channel having first apertures therealong substantially aligned with alternately-spaced perforations of said spaced perforations in said liner to allow said fluid egress from said fluid injection channel and to permit said fluid to flow into said dedicated fluid injection fractures and, using pressurized injection of said fluid into each of said dedicated fluid injection fractures, driving hydrocarbons in said reservoir in a direction substantially parallel to said horizontal wellbore into respectively mutually adjacent dedicated hydrocarbon recovery fractures; and (vi) simultaneously recovering hydrocarbons which flow into said dedicated hydrocarbon recovery fractures via said separate hydrocarbon recovery channel in said multi-channel tubing and via second apertures spaced along said hydrocarbon recovery channel which allow ingress of hydrocarbons from said dedicated hydrocarbon recovery fractures.

2. The method as claimed in claim 1, wherein said multi-channel tubing further comprises a packer actuation channel therein and said packer elements comprise hydraulically-actuated packers, said method further comprising:

prior to, or at the time of, injecting said fluid into said fluid injection channels, supplying said fluid or another fluid to said packer actuation channel to actuate said hydraulically-actuated packers so as to cause said hydraulically-actuated packers to prevent fluid communication between said dedicated hydrocarbon recovery fractures and said dedicated fluid injection fractures via said wellbore.

3. The method as claimed in claim 1, wherein said first and/or second apertures in said tubing are created at the surface and prior to insertion of said tubing in said wellbore.

4. The method as claimed in claim 1, wherein said packer elements each comprise at least one piston member which may be hydraulically actuated to compress an elastomeric portion of such packer element for actuation, said method further comprising:

prior to, or at the time of, injecting said fluid into said fluid injection channel, supplying said fluid or another fluid to said packer actuation channel to actuate said hydraulically-actuated packers so as to cause said packers to be actuated and prevent fluid communication between said dedicated hydrocarbon recovery fractures and said dedicated fluid injection fractures via said wellbore.

5. The method as claimed in claim 1, wherein said step of injecting a fluid comprises injecting water, a non-combustible gas, or a viscous liquid.

6. The method as claimed in claim 1, wherein said step of injecting a fluid comprises an oil or a gas which is miscible or immiscible in oil.

7. A method for recovering hydrocarbons from a subterranean petroleum reservoir by sweeping the subterranean petroleum reservoir, comprising the steps of:

(i) drilling a horizontal wellbore through said petroleum reservoir, in a substantially lower portion of said petroleum reservoir;

(ii) inserting a liner in said horizontal wellbore, wherein said liner contains spaced perforations therein in specific intervals therealong and said liner is inserted so that said spaced perforations therein are proximate, respectively, spaced hydraulic fractures along said horizontal wellbore, wherein said spaced hydraulic fractures extend substantially radially outwardly from and are spaced laterally along said horizontal wellbore, or alternatively perforating said liner after inserting said liner in said horizontal wellbore and subsequently forming said spaced hydraulic fractures in said petroleum reservoir along said horizontal wellbore at said locations of said spaced perforations in said liner by application of fluid under pressure to said wellbore, or alternatively perforating said liner at locations of said spaced hydraulic fractures previously formed along said horizontal wellbore, said spaced hydraulic fractures comprising a plurality of dedicated fluid injection fractures and a substantially corresponding number of dedicated hydrocarbon recovery fractures, wherein said dedicated fluid injection fractures and said dedicated hydrocarbon recovery fractures are alternately spaced along said wellbore;

(iii) inserting a single multi-channel tubing in said liner, said multi-channel tubing having a plurality of individual discrete channels therein, including:

(a) a fluid injection channel, having first apertures therein spaced laterally along a length thereof, corresponding in number to a number of said dedicated fluid injection fractures along said wellbore;

(b) a separate hydrocarbon recovery channel, having second apertures therein laterally spaced along a length thereof and alternatingly spaced with said first apertures along said multi-channel tubing, corresponding in number to a number of said dedicated hydrocarbon recovery fractures along said wellbore; and (c) packer elements spaced along a length of said multi-channel tubing and respectively located between said first and second apertures thereon, wherein said first apertures and said second apertures are alternately spaced, said packer elements each configured when actuated to prevent fluid communication along said wellbore between adjacent hydraulic fractures of said spaced hydraulic fractures;

and positioning said multi-channel tubing and said packer elements thereon in said liner so as to locate:

(a) said first apertures in said fluid injection channel so that each are respectively in fluid communication with and in proximity to a respective one of said dedicated fluid injection fractures along said wellbore, and (b) said second apertures in said hydrocarbon recovery channel so that each are in fluid communication with and in proximity to a respective one of said dedicated hydrocarbon recovery fractures along said wellbore; and (c) said packer elements on either side of each individual perforation of said spaced perforations in said liner;

(iv) actuating said spaced packer elements so as to create a seal between said multi-channel tubing and said liner in said wellbore and thereby prevent an injection fluid injected in said multi-channel tubing from communicating between said adjacent hydraulic fractures of said spaced hydraulic fractures via said hollow liner;

(v) injecting said injection fluid into said dedicated fluid injection fractures via said first apertures in said fluid injection channel, and, using pressurized injection of said injection fluid into each of said dedicated fluid injection fractures, driving hydrocarbons in said reservoir in a direction substantially parallel to said horizontal wellbore into respectively mutually adjacent dedicated hydrocarbon recovery fractures; and (vi) simultaneously recovering to surface hydrocarbons which flow from said reservoir into said dedicated hydrocarbon recovery fractures via said second apertures in said hydrocarbon recovery channel.

8. The method as claimed in claim 7 wherein said packer elements comprise hydraulically-actuated packers, said method further comprising:

prior to, or at the time of, injecting said fluid into said fluid injection channel, supplying said injection fluid or another fluid to actuate said hydraulically-actuated packers so as to cause said packers to be actuated and prevent fluid communication via said wellbore between said dedicated hydrocarbon recovery fractures and said dedicated fluid injection fractures.

9. The method as claimed in claim 7, wherein said multi-channel tubing further comprises a packer actuation channel therein and said packer elements comprise hydraulically-actuated packers, said method further comprising:

prior to, or at the time of, injecting said fluid into said fluid injection channel, supplying said fluid or another fluid to said packer actuation channel to actuate said hydraulically-actuated packers so as to cause said hydraulically-actuated packers to prevent fluid communication via said wellbore between said adjacent hydraulic fractures of said spaced hydraulic fractures.

10. The method as claimed in claim 7, wherein said step of injecting said injection fluid comprises injecting water, a non-combustible gas, or a viscous liquid.

11. The method as claimed in claim 7, wherein said step of injecting said injection fluid comprises an oil or a gas which is miscible or immiscible in oil.

* * * * *